United States Patent [19]

Fossan et al.

[11] 4,032,376

[45] June 28, 1977

[54] EXPLOSIVE COMPOSITION WITH TELLURITE GELLING AGENT

[75] Inventors: Kåre Ragnvald Fossan, Nora; Gunnar Olof Ekman, Gyttorp, both of Sweden

[73] Assignee: Nitro-Nobel A.B., Gyttorp, Sweden

[22] Filed: Apr. 22, 1976

[21] Appl. No.: 679,240

[30] Foreign Application Priority Data

Apr. 29, 1975 Sweden ..... 7504939

[52] U.S. Cl. ..... 149/60; 149/43; 149/44; 149/61

[51] Int. Cl.[2] ..... C06B 31/30

[58] Field of Search ..... 149/44, 43, 60, 61

[56] References Cited

UNITED STATES PATENTS

| | | | |
|---|---|---|---|
| 3,684,594 | 8/1972 | Evans | 149/44 X |
| 3,770,523 | 11/1973 | Biswas | 149/44 X |
| 3,791,255 | 2/1974 | Fox et al. | 149/44 X |

*Primary Examiner*—Stephen J. Lechert, Jr.
*Attorney, Agent, or Firm*—Hane, Sullivan & Spiecens

[57] ABSTRACT

An explosive composition, fluid when formulated and gelling to a paste at a predetermined time is provided. The composition, which is particularly useful for blasting rocks and can be readily poured or pumped into drillholes, comprises an oxidant, a combustible, a gelling agent, water and a gelling promoter.

9 Claims, No Drawings

EXPLOSIVE COMPOSITION WITH TELLURITE GELLING AGENT

The present invention relates to an explosive composition in the form of a paste, containing explosives of the ammonium nitrate type admixed with water and other materials. The explosive compositions of the present invention can be prepared either in finished form ready for use when desired or in situ just prior to use. The latter is preferred when the explosive composition is to be detonated inside drill holes in rocks. The materials in fluid form, are then poured into such holes and the paste forms therein.

The explosive composition of the present invention when prepared in situ, e.g. in a drill hole, just prior to use, are substantially resistant to mechanical shock, so the compositions may be readily poured or pumped into the drill hole with substantially no danger of being detonated by mechanical shock.

The explosive compositions of the present invention contain a substantially uniform mixture of an oxidant and a combustible material substantially uniformly distributed in a fluid water-containing medium which will gel to form a paste in which the oxidant and combustible are still substantially uniformly distributed. Such uniform distribution is desired to achieve maximum explosive power and maximum stability while the fluid composition is being poured. If any separation occurs, both the explosive power and stability to mechanical shock are reduced.

The preferred compositions of the present invention which are prepared in situ should be sufficiently fluid over the period of time in which they are being poured or pumped into the drill hole, and still solidify rapidly enough after being brought to the place where needed, so that no further flow, such as, for example, seepage into crevices of the rock or back-flow when the fluid was pumped upward.

In accordance with the present invention this gelling is achieved by having a gelling agent which forms cross links and thus gels as the cross links form and an agent which promotes the formation of such cross links and the consequent gelling.

By controlling the ratio of the amounts of gelling agent and the promoter the rate of gellation can be controlled so that gellation can occur practically instantaneously or at a predetermined time during a period extending, if desired, to several days.

Accordingly, the present invention provides an explosive composition which is fluid in its original form and then becomes a paste, which comprises an oxidant, a combustible, water, gelling agent and a gelling promoter.

Preferred compositions contain about 70–86 parts oxidant, about 4–8 parts combustible, about 5–9 parts water, about 1–3 parts gelling agent, and about 0.005–0.2 parts gelling promoter, where parts refer to parts by weight. Hereinafter, unless otherwise noted, parts will refer to parts by weight.

Suitable oxidants include inorganic nitrates, e.g. ammonium nitrate and sodium nitrate. As combustible materials there are used carbohydrates (e.g. starches, sugars, cellulose), hydrocarbons, carbon-like materials such as charcoal, finely ground coal, and the like, urea and urea derivatives, and finely divided metals and other combustibles such as sulfur. To increase the stability and the explosive force other explosives such as trinitrotoluene, nitrocellulose, pentaerythritol tetranitrate and alkylammonium nitrates may be added.

Suitable gelling agents are galactomannans, such as guar gums which are high molecular weight polysaccharides made up of galactose and mannose units. These materials are capable of forming cross links between the molecules to produce the gelling effect.

Suitable promoters for the control of the rate of gellation are tellurites, for example alkali metal tellurites such as sodium tellurite and potassium tellurite. Tellurites have the property of promoting the rate of formation of cross links between the molecules of the gelling agent thus increasing the rate of gellation, and the rate of gellation can be increased or decreased by increasing or decreasing the ratio of the amount of the tellurite to the amount of gelling agent.

The tellurite may be replaced in part with a chromate or bichromate. Preferred chromates or bichromates are those of sodium or potassium. Chromates and bichromates have a commercial advantage over tellurites, being lower in cost.

The effect of tellurites and bichromates on the rate of gellation is substantially temperature independent so that for the same ratio of promoter to gelling agent, the rate of gellation will substantially be the same at 5° as at 20° C.

It is also within the scope of the present invention to place within the same drill hole compositions having different rates of gellation. For example, it may be desired to place firstly a composition having a slow rate of gellation and then a composition having a very rapid rate of gellation. The second composition would then form a plug over the still fluid composition which had been first placed in the hole. This eliminates the need for special plugs or stoppers. The invention will be described more fully in the examples which follow. These examples are given by way of illustration and are not to be considered as limiting.

A composition containing

| | |
|---|---|
| methylammonium nitrate | 20 parts |
| water | 7 parts |
| urea | 6 parts |
| ammonium nitrate | 57 parts |
| sodium nitrate | 9 parts |
| guar gum | 1 part |

were prepared.

To 1 kg of each such compositions there was added the amounts of gelling promoter as given in the examples below. All experiments were conducted at 20° C. Gellation was considered complete when a substantially stiff and gummy paste formed.

EXAMPLE 1

0.05 g Sodium tellurite was the promoter. Gellation was slow, beginning in about 1 to 2 hours, and was complete in about 12 hours.

EXAMPLE 2

0.1 g Sodium tellurite was the promoter. Gellation was rapid, beginning in about 1 to 2 minutes, and was complete in about 15 minutes.

The same effect was obtained with a mixture of 0.02 g sodium tellurite and 0.2 g sodium chromate.

EXAMPLE 3

0.25 g Sodium tellurite was the promoter. Gellation was substantially complete in about 2 to 3 minutes. The product was allowed to stand for 1 month at 20° C. but no synaresis was noted.

The same effect was obtained with a mixture of 0.05 g potassium tellurite and 0.05 g sodium chromate.

EXAMPLE 4

0.5 g Potassium tellurite was the promoter. Gellation occurred practically instantaneously, to that gellation appeared complete in about to 1 minute. No synaresis was noted after the composition stood for 1 week at 20° C.

The same effect was obtained with a mixture of 0.1 g potassium tellurite and 1.0 g potassium chromate.

The same experiments were repeated at a temperature of 5° C. and substantially the same results were obtained.

The compositions thus prepared have good explosive properties and are resistant to mechanical shock. They can be detonated in the usual manner.

We claim:

1. In an explosive composition that is first in fluid form and then gels into a paste at a predetermined rate, which explosive composition comprising an oxidant, a combustible, water, a gelling agent, and a gelling promoter, wherein the improvement comprises: said gelling agent being selected from the group consisting of a tellurite, a mixture of a tellurite and a chromate, and a mixture of a tellurite and a bichromate.

2. The improvement according to claim 1, wherein said gelling agent consists of an alkali metal tellurite.

3. The improvement according to claim 2, wherein said gelling agent consists of sodium tellurite in the amount of between 0.05 and 0.25 grams per kilogram of explosive composition.

4. The improvement according to claim 2, wherein said gelling agent consists of potassium tellurite.

5. The improvement according to claim 1, wherein said gelling agent consists of a mixture of sodium tellurite and sodium chromate.

6. The improvement according to claim 1, wherein said gelling agent consists of a mixture of potassium tellurite and sodium chromate.

7. The improvement according to claim 1, wherein said gelling agent consists of a mixture of potassium tellurite and potassium chromate.

8. The improvement according to claim 1, comprising 70–86 parts by weight of oxidant, about 4–8 parts by weight of combustible, about 5–9 parts by weight of water, about 1–3 parts by weight gelling agent, and about 0.005–0.2 parts by weight gelling promoter.

9. The improvement according to claim 8, wherein said oxidant is selected from the group consisting of ammonium nitrate, sodium nitrate, and methylammonium nitrate; said combustible being selected from the group consisting of urea, hydrocarbons, and carbohydrates; and said gelling agent being a galactomannans, such as guar gum.

* * * * *